United States Patent [19]

Iskra et al.

[11] 4,352,593

[45] Oct. 5, 1982

[54] DAM SPILLWAY

[76] Inventors: Anton L. Iskra, ulitsa Magdagulovoi, 8, korpus 1, kv. 65, Moscow; Mikhail S. Kharchenko, ulitsa Semashko, 8, korpus 1, kv. 135, Zhukovsky Moskovskoi oblasti; Jury N. Vasiliev, ploschad Vosstania, 1, kv. 60, Moscow, all of U.S.S.R.

[21] Appl. No.: 219,901

[22] Filed: Dec. 23, 1980

[51] Int. Cl.[3] ..... E02B 8/06

[52] U.S. Cl. ..... 405/108; 405/80

[58] Field of Search ..... 405/80–87, 405/107–115, 74

[56] References Cited

U.S. PATENT DOCUMENTS

| | | | |
|---|---|---|---|
| 799,829 | 9/1905 | Church | 405/108 |
| 942,645 | 12/1909 | Icke | 405/108 |
| 1,675,001 | 6/1928 | Spooner | 405/108 |
| 2,103,600 | 12/1937 | Stevens | 405/87 |
| 2,762,202 | 9/1956 | Ponsar | 405/108 |
| 3,461,674 | 8/1969 | Katzer et al. | 405/74 |

*Primary Examiner*—Dennis L. Taylor

*Attorney, Agent, or Firm*—Robert E. Burns; Emmanuel J. Lobato; Bruce L. Adams

[57] ABSTRACT

A dam spillway to pass water over the crest from a forebay into an afterbay comprises a mixing chamber communicating with a diffuser; said mixing chamber has an intake arrangement ensuring formation downstream of the diffuser of a flotation zone with a froth collector installed at the end thereof; said intake arrangement includes a water flow divider, a water breaking grid and air intake ducts, the divider being installed above the chamber and made in the form of a screen composed of chutes; said water breaking grid of the intake arrangement composed of bluff members is provided in the inlet portion of the chamber, whereas the air intake ducts of said intake arrangement are made in a wall of the mixing chamber below the grid in close proximity thereto.

3 Claims, 4 Drawing Figures

DAM SPILLWAY

FIELD OF THE INVENTION

The invention relates to spillways of hydraulic structures, and more specifically to spillways of dams, in which passage of water from a forebay into an afterbay is carried out by overflow across the dam crest.

The proposed invention may be used to advantage for aeration of water passed through the hydraulic structure and is intended to dissipate the kinetic energy of the flow of water being passed, cleaning it of impurities liable to flotation and oxidation.

BACKGROUND OF THE INVENTION

Known in the art are dam spillways made in the form of open or closed channels communicating the reservoirs upstream and downstream of the dam and provided with the water flow kinetic energy dissipators (cf. Specification to U.S. Pat. No. 2,103,600 cl. 61-18, filed Dec. 21, 1935, Specification to USSR Inventor's Certificate No. 124, 370 cl. E02B 8/06, filed Feb. 10, 1959 and Specification to USSR Inventor's Certificate No. 697,628 cl. E02B 8/06, filed Oct. 3, 1974). Owing to the use of kinetic energy dissipators, such spillways are capable of discharging not only the principal function consisting in purposeful passage of the required water flow from the forebay into the afterbay, but also in preventing gradual destruction of the spillway walls and the afterbay bottom caused by the water flow. Spillways with kinetic energy dissipators are ordinarily installed on diversion dams erected in running-water reservoirs and intended for a comparatively small increase in the water level in the reservoir upstream of the dam with the purpose of, e.g., ensuring safety of navigation. The difference in the forebay and afterbay levels on such a dam being relatively small, its use, e.g. for power generation, is impracticable from the point of view of economy. On the other hand, said difference is detrimental as regards water passage from the forebay into the afterbay, for the high velocity water head arising due to said difference brings about gradual destruction of the spillway walls located in the vicinity of the afterbay and the bottom thereof. To prevent destruction, the prior art designs employ dissipation of the kinetic energy of the water flow being passed. To this end, the outlet sections of the spillway are provided with kinetic energy dissipators made either in the form of small bluff baffle piers causing considerable energy losses when flown around (cf. U.S. Pat. No. 2,103,600) or in the form of a screen dividing the flow into separate jets whose confluence results in dissipation of the flow kinetic energy (cf. USSR Inventor's Certificate No. 124,300), or in the form of widening troughs installed step-wise on narrowing buttresses (cf. USSR Inventor's Certificate No. 697,628) wherein energy dissipation is effected due to both factors employed in the first two solutions.

However, in the prior art spillways the energy of the high velocity water flow is completely wasted to be lost irreversibly.

Also known are devices (cf. Specifications to U.S. Pat. Nos. 3,461,674 cl. 61-2, filed Jan. 20, 1967 and 3,893,924 cl. 210-220, filed Oct. 19, 1973) intended for aeration of water in reservoirs and made in the form of a system of pipes with perforations, laid in the proximity of the reservoir bottom, through which perforations air preliminarily mixed with water issues into the bottom layers of the reservoir. Air-water mixture under a pressure exceeding that in the reservoir bottom layers is supplied into said pipes either with the aid of a mixer (cf. U.S. Pat. No. 3,461,674) whereto air and water are delivered by a fan and a pump respectively or by means of an air-water ejector (cf. U.S. Pat. No. 3,893,924) whereto air is carried by the water injected by the pump. However, air supply calls for certain consumption of power to drive the pump and the fan, this consumption for a definite period of time, e.g. a year, becoming quite appreciable due to constant operation of said devices. Moreover, these solutions do not feature design characteristics which would allow them to be used as dam spillways.

Another prior art dam spillway to pass water from a forebay into an afterbay over the dam crest includes a vertically disposed mixing chamber having an inlet section opening into the atmosphere and communicating with a horizontally arranged diffuser (cf. Specification to USSR Inventor's Certificate No. 340,735 cl. E02B 7/00, filed Jan. 4, 1971). The downward flow of water being passed through said spillway may entrain air into the mixing chamber via the mixing chamber inlet section opening into the atmosphere. In said chamber a certain portion of the kinetic energy of the water is imparted to the air. Owing to such utilization of the water kinetic energy generated as a result of the transformation of the difference in the forebay and afterbay levels, said prior art device may ensure, simultaneously with passing water over the dam, aeration of the water, thereby contributing to saturation of the latter with oxygen.

However, the water in said prior art device flows down into the mixing chamber in a single stream, owing to which circumstance the air-water interface is comparatively small. Accordingly, the amount of air entrained by the water flow and, consequently, the degree of the water saturation with oxygen are also small. The low air flow rate in said prior art device results in a low efficiency of dissipating the water kinetic energy by admixing air to the water.

SUMMARY OF THE INVENTION

An object of the present invention is to increase a flow rate of air contacting with water being passed over a dam and to ensure with the aid of this air a more efficient dissipation of the kinetic energy of the water flow, a higher degree of saturating the water with oxygen and cleaning it of all kinds of impurities liable to flotation and oxidation.

The invention essentially resides in that in a dam spillway intended to pass water over the crest from a forebay into an afterbay, whose channel comprises a vertically disposed mixing chamber with an inlet section opening into the atmosphere and communicating with a horizontally mounted diffuser, according to the invention, the mixing chamber has an intake arrangement ensuring formation downstream of the diffuser of a flotation zone, comprising a water flow divider located above the mixing chamber and made in the form of a screen composed of chutes, a water breaking grid installed transversely in the inlet portion of the mixing chamber and composed of bluff members, and air intake ducts made in the wall of the mixing chamber below the water breaking grid in close proximity thereto, whereas a froth collector is arranged on the surface of the afterbay downstream from the flotation zone.

To raise the degree of cleaning the water of floatable impurities and the degree of saturating with oxygen of the excessive portion of the water flowing outside the mixing chamber, it is practicable that the dam spillway has an air separation chamber with an upper wall thereof attached to the upper wall of the diffuser in a steplike manner and provided with perforations to create thereabove a flotation zone, an adjustable perforated baffle being attached to the upper wall of the air separation chamber at the outlet thereof.

To ensure a long life for the spillway, it is desirable that the latter contains n additional channels disposed equidistantly with the main channel, each comprising a mixing chamber with an intake arrangement, communicating with the diffuser.

BRIEF DESCRIPTION OF THE DRAWINGS

These and other objects of the present invention will become apparent from consideration of a specific embodiment thereof taken in conjunction with the accompanying drawings, wherein.

DETAILED DESCRIPTION OF THE INVENTION

Figure 1:
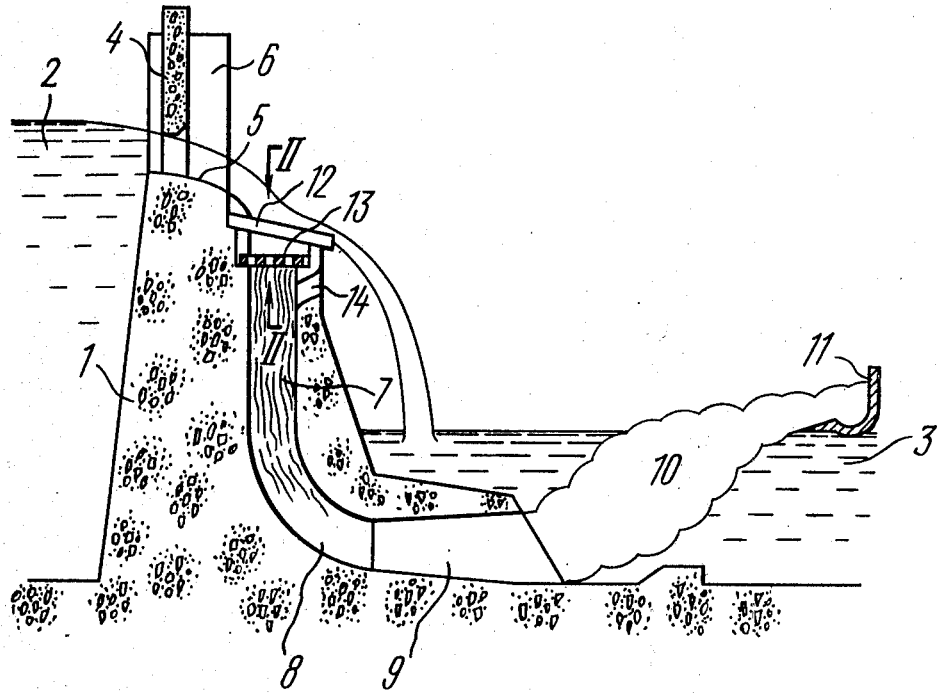
FIG. 1 is a longitudinal section of a dam spillway, according to the invention.

A spillway of the invention is made in a body of a dam 1 (FIG. 1) separating a forebay 2 and an afterbay 3 and provided with a gate 4 arranged on a crest 5 of the dam 1 in piers 6. The spillway channel has a vertically disposed mixing chamber 7 smoothly associated through an elbow 8 with a horizontally mounted diffuser 9. The mixing chamber 7 has an intake arrangement ensuring formation downstream of the diffuser 9 in the afterbay 3 of a flotation zone 10 provided at the end whereof is a froth collector 11. The intake arrangement comprises a water flow divider 12, a water breaking grid 13 and air intake ducts 14.

The water flow divider 12 is installed above the mixing chamber 7, the water breaking grid 13 being located under the divider in the inlet section of the mixing chamber 7. The air intake ducts 14 are provided in the wall of the mixing chamber 7, facing the afterbay 3 below the water breaking grid 13 in close proximity thereto.

Figure 2:
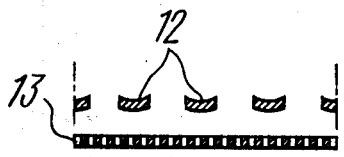
FIG. 2 is the section II—II of FIG. 1, according to the invention.

The flow divider 12 (FIG. 2) is made in the form of a screen composed of chutes arranged along the water flow and inclined towards the afterbay 3, whereas the water breaking grid 13 is made from bluff members, e.g. square-section bars.

Figure 3:
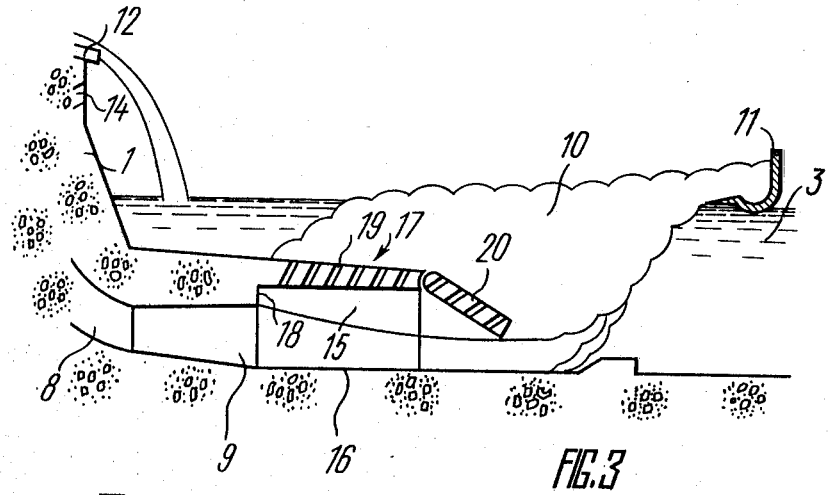
FIG. 3 is a longitudinal section of an air separation chamber, according to the invention.

The diffuser 9 may have attached thereto an air separation chamber 15 (FIG. 3) disposed in the flotation zone 10. The air separation chamber 15 is formed by a bottom 16 of the afterbay 3 and a horizontally mounted panel 17 connected with the diffuser 9 so as to form a step 18. The panel 17 is provided with perforations 19. An adjustable perforated baffle 20 is attached to the outlet end of the panel 17.

Figure 4:
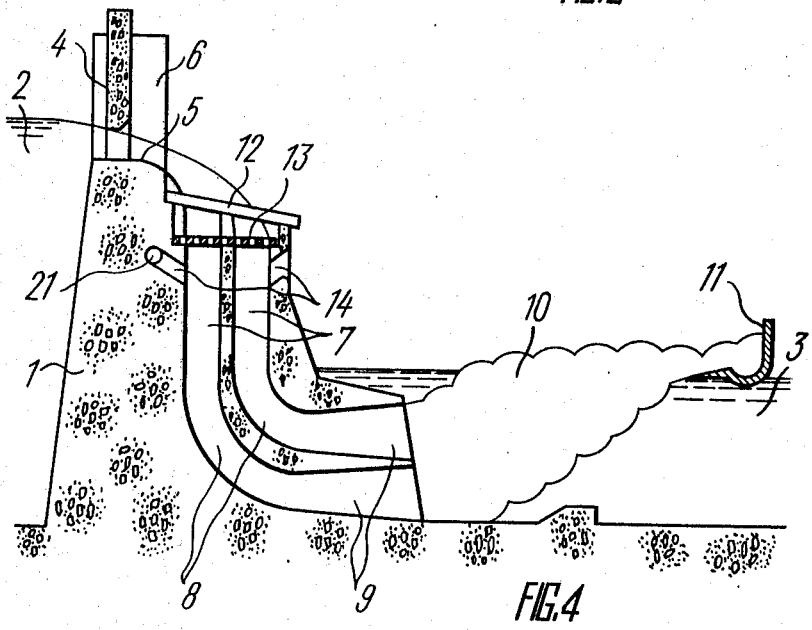
FIG. 4 is a longitudinal section of a spillway with two channels, according to the invention.

The spillway of the invention may be made in the form of not only one, but also two similar equidistant channels. In the latter case the flow divider 12 (FIG. 4) and the water breaking grid 13 are common for both channels. Each channel includes the air intake ducts 14, the mixing chamber 7 communicating with the diffuser 9 through the elbow 8. Air flows into the ducts 14 of the mixing chamber 7 located closer to the forebay 2 through air channels 21 provided in the body of the dam 1.

From the forebay 2 (FIG. 1) the water, whose flow rate is controlled by the gate 4, flows over the crest 5 of the dam 1 and thence onto the water flow divider 12. The size of the chutes forming the divider 12 (FIG. 2) and also the relationship between the size of the chutes and the width of the slot therebetween are selected in such a manner that in the event of the actual flow of water exceeding the rated flow of the water being passed through the dam 1 the divider 12 (FIG. 1) divides the actual flow into two parts, one part of the actual flow equal to the calculated one running into the inlet section of the mixing chamber 7 and the other (excessive) part thereof draining directly into the afterbay 3 through the chutes of the divider 12 past the mixing chamber 7. Downstream of the divider 12 the part of the water flow channelled by the divider 12 into the mixing chamber 7 falls onto the water breaking grid 13 arranged across the water flow in the inlet section of the mixing chamber 7. The water breaking grid being made from bluff members, the water flow passing therethrough is broken into a multitude of individual jets and drops. Owing to the sharp increase in the gas-liquid interface downstream of the water breaking grid 13, the jets and drops of water flowing down into the vertically disposed mixing chamber 7 entrain a large amount of the air taken in from the atmosphere through the ducts 14 in the wall of the mixing chamber 7, provided below the water breaking grid 13. As the divider 12 constantly supplies into the mixing chamber 7 an amount of water approximating the rated flow thereof through the dam 1, the relationship between the summary cross-sectional areas of the water and air jets in the mixing chamber 7 and, consequently, the cross-sectional area of the mixing chamber 7 may be selected in such a manner that the mixing chamber 7 will continuously ensure a flow rate of the air drawn thereinto close to the maximum air flow rate at the rated water flow rate.

The increased gas-liquid interface downstream of the water breaking grid 13 also improves the contact between the water and air, i.e. intensifies the process of aeration. This and the increased air flow rate in the mixing chamber 7 generate intensive processes of saturation of water with oxygen (dissolution of oxygen in the water) and oxidation of the impurities contained in the water, which can be decontaminated by oxidation. Flowing down by gravity, the water jets increase their velocity in the mixing chamber 7. Intermixing with the air, the water jets simultaneously increases the velocity thereof, thereby imparting a certain amount of the kinetic energy of the water. An air-water mixture formed in the mixing chamber 7 runs into the elbow 8 wherein the direction of the flow is smoothly changed from vertical to horizontal. Owing to the smooth curvature in the shape of the elbow 8, the change of the flow direction is effected with minimal energy losses. The air-water mixture being a compressible medium, impact of the air-water flow against the lower wall of the elbow 8 substantially attenuates the process of gradual destruction of the wall. From the elbow 8 the air-water mixture runs into the diffuser 9 wherein the air-water flow is braked. Owing to this, the flow kinetic energy is dissipated, thereby drastically delaying the process of gradual destruction of the bottom of the afterbay 3 in the vicinity of the flow outlet from the spillway. As braking occurs in the diffuser 9, the major part of the kinetic energy of the air-water flow does not disappear, but is transformed into the energy of pressure of this flow, as a result of which the static pressure of the air-water flow (and of the air contained therein) in the outlet section of the diffuser 9 goes up to exceed the atmospheric pressure, which allows the outlet section of the diffuser 9 to be lowered to a definite depth into the afterbay 3, thereby ensuring air supply to this depth. The processes of water saturation with oxygen and decontamination of impurities by oxidation continue in the elbow 8 and the diffuser 9, the saturation process in the diffuser 9 intensifying as the amount of oxygen dissolved in the water grows in proportion to the rise of the static pressure. The braked air-water flow issues from the diffuser 9 into the bottom layers of the afterbay 3, wherein the flotation zone 10 is formed. The air bubbles contained in the water entrain impurities liable to flotation, and likewise contained in the water, to the surface of the afterbay 3. In the flotation zone 10 the air bubbles brought by the water from the diffuser 9 also permeate the excessive part of the water flow which is channeled by the divider 12 directly into the afterbay 3 past the mixing chamber 7, said part of the water flow being also liberated from the floatable impurities and partially saturated with oxygen. The forth formed on the surface of the afterbay 3 as a result of flotation is collected by the froth collector 11 together with the impurities extracted from the water and is expelled from the reservoir, thereby ensuring, along with oxidation, purification of the water being passed over the dam 1. The purified water flowing under the froth collector 11 still contains finest air bubbles which can be carried by the current to considerable distances from the dam 1, which, together with the oxygen dissolved in the water, ensures restoration and maintenance of the biological capacity of the water medium for self-purification.

To raise the degree of cleaning the water of floatable impurities and of saturating with oxygen of the excessive part of the water flow running past the mixing chamber 7, the flotation zone 10 (FIG. 3) may be expanded by installing the air separation chamber 15 having the upper perforated panel 17 downstream of the diffuser 9. Owing to presence of the step 18, a zone of stalling of the air flow running out of the diffuser 9 is formed in the upper portion of the air separation chamber 15. Air is separated from the air-water flow to arrive in the stalling zone. Under the action of the excessive pressure built up in the air separation chamber 15 by the diffuser 9 the air is expelled from the stalling zone in the form of minute bubbles into the excessive portion of the water flow running over the panel 17 through the perforations 19 of the panel 17. The flotation zone 10 is thus expanded by the length of the water separation chamber 15. Besides, the size of the air bubbles getting into the excessive portion of the water flow can be preset arbitrarily by selecting the size of the perforations 19 in the panel 17. These circumstances allow optimal conditions to be created for raising the degree of cleaning the water of impurities and saturating the excessive portion of the water flow with oxygen. Adjusting the position of the baffle 20 makes it possible to control the pressure in the air separation chamber 15, thereby creating optimal conditions for operation of the latter.

In cases when the operating time of a spillway with the actual flow rate exceeding the rated value accounts for a considerable portion of the total operating time of the spillway, it is advisable to make the latter consisting of two similar channels (FIG. 4), the channel located closer to the forebay 2 being calculated for the rated flow and the other channel, for a certain excessive portion of the flow. With such a design the advantages offered by the proposed solution with respect to the portion of the flow equal to the rated value are also applicable to the excessive portion of the water flow.

For an appreciable increase in the flow of air coming into a direct contact with the water being passed, the spillway of the proposed design permits to use the kinetic energy of the water falling down from the crest 5 of the dam 1 in the course of passing the water from the forebay 2 (FIG. 1) into the afterbay 3. Owing to an increased flow rate of this air in the spillway of the proposed design, the kinetic energy of the water being passed is dissipated more efficiently, the amount of oxygen dissolved in the water increases, which results in a decreased amount of impurities left in the water.

What is claimed is:

1. A dam spillway to pass water over the crest from a forebay into an afterbay, comprising:

a vertically disposed mixing chamber having an inlet section opening into the atmosphere;

a horizontally mounted diffuser communicating with said mixing chamber; an upper wall of said diffuser;

a flotation zone;

an intake arrangement of said mixing chamber, ensuring formation of said flotation zone downstream of said diffuser;

a water flow divider of said intake arrangement, located above said mixing chamber and made in the form of a screen composed of chutes;

a water breaking grid of said intake arrangement, installed transversely in said inlet section of said mixing chamber and composed of bluff members;

air intake ducts of said intake arrangement, made in a wall of said mixing chamber below said water breaking grid in close proximity thereto;

a froth collector arranged on the surface of said afterbay downstream of said flotation zone.

2. A dam spillway as claimed in claim 1, comprising:

an air separation chamber, an upper wall of said air separation chamber; said upper wall attached to said upper wall of said diffuser in a step-like manner and provided with perforations to create thereabove said flotation zone;

an adjustable perforated baffle attached to said upper wall of said air separation chamber at the outlet thereof.

3. A dam spillway to pass water from the forebay into the afterbay, comprising:

n channels disposed equidistantly relative to each other;

n vertically disposed mixing chambers equal to the number of channels, an outlet section of each of said n mixing chambers opening into the atmosphere;

n horizontally mounted diffusers equal to the number of said mixing chambers; each of said n diffusers communicating with a suitable chamber out of said n mixing chambers;

a flotation zone formed downstream of said n diffusers;

n intake arrangements equal to the number of said mixing chambers, ensuring formation of said flotation zone;

n water flow dividers equal to the number of intake arrangements, joined in a single common water flow divider disposed above said n mixing chambers and made in the form of a screen composed of chutes;

n water breaking grids equal to the number of intake arrangements, joined in a single common water breaking grid installed in said inlet sections of each of n said mixing chambers and composed of bluff members;

n air intake ducts equal to the number of said intake arrangements, made in the walls of suitable said n mixing chambers below said single common water breaking grid in close proximity thereto;

a froth collector arranged on the surface of said afterbay downstream of said flotation zone.

* * * * *